US006694753B1

(12) United States Patent
Lanz et al.

(10) Patent No.: US 6,694,753 B1
(45) Date of Patent: Feb. 24, 2004

(54) DEFROST DELAY MODULE

(75) Inventors: Douglas C. Lanz, South Elgin, IL (US); James C. Johncock, Shelbyville, MI (US)

(73) Assignee: Robertshaw Controls Company, Richmond, VA (US)

( * ) Notice: Subject to any disclaimer, the term of this patent is extended or adjusted under 35 U.S.C. 154(b) by 0 days.

(21) Appl. No.: 10/196,536

(22) Filed: Jul. 16, 2002

Related U.S. Application Data

(60) Provisional application No. 60/305,983, filed on Jul. 17, 2001.

(51) Int. Cl.[7] ..... F25D 21/06

(52) U.S. Cl. ..... 62/155; 62/158; 62/156; 307/39

(58) Field of Search ..... 62/151, 154, 155, 62/156, 234, 158, 157, 230; 307/35, 39

(56) References Cited

U.S. PATENT DOCUMENTS 4,909,041 A * 3/1990 Jones ..... 62/157
5,148,686 A 9/1992 You ..... 62/234
5,415,005 A 5/1995 Sterber et al. ..... 62/154
5,515,692 A * 5/1996 Sterber et al. ..... 62/155
5,524,448 A * 6/1996 Schwanebeck et al. ..... 62/158
6,026,651 A 2/2000 Sandelman ..... 62/155

* cited by examiner

*Primary Examiner*—Harry B. Tanner
(74) *Attorney, Agent, or Firm*—Leydig, Voit & Mayer, Ltd.

(57) ABSTRACT

A device and method for automatically defrosting a refrigeration system only during times of non-peak energy demand. The device is a defrost delay module that plugs into the current defrost timer supplied with frost-free refrigerators. The defrost delay module includes a microprocessor that utilizes a clock to define peak power consumption periods. If the defrost cycle will occur during a peak power period, the delay module interrupts the normal operation and prevents defrosting of a refrigerator or freezer until the peak power periods has passed. The delay module is able to learn the operating characteristics of the defrost timer such that the delay module can be retrofit to existing appliances.

11 Claims, 4 Drawing Sheets

DEFROST DELAY MODULE

CROSS REFERENCE TO RELATED APPLICATION

The present application is based on and claims priority to U.S. Provisional Patent Application Ser. No. 60/305,983, filed on Jul. 17, 2001, the disclosure of which is incorporated herein by reference.

BACKGROUND OF THE INVENTION

The present invention generally relates to the automatic control of an appliance. More specifically, the present invention relates to a method and control module for controlling the operation of the defrost cycle of a refrigerator based upon the time of day such that the defrost cycle will not activate during peak demand times.

Currently, rolling blackouts are occurring in parts of the United States because of large energy requirements versus short energy supplies occurring during peak demand times. In states that are experiencing rolling blackouts, incentives are given to energy consumers for reducing the use of energy during such peak demand times.

Currently available domestic frost-free refrigerators defrost approximately once per day, which creates a 300–500 watt load during the defrost cycle. Most frost-free refrigerators use an electromechanical timer with switching to run a defrost heater that is placed around the refrigerator evaporator coil. The electromechanical timer is configured to switch to the defrost operation after a certain amount of compressor run time (typically 6 to 12 hours). Thus, the triggering of the defrost cycle is based upon the run time of the compressor, such that the defrost cycle can occur at any time during the day and at different times on a day-to-day basis.

Due to the energy supply problems in several states, a need exists for a control module that prevents the operation of the defrost cycle of a frost-free refrigerator during peak demand times. Further, a need exists for a defrost timer that can be retrofit onto frost-free refrigerators currently in use. It is an additional object of the present invention to provide a defrost delay control module that learns the defrost cycle of the current defrost timer and prevents the activation of the defrost heater during peak demand times.

SUMMARY OF THE INVENTION

The present invention relates to a device and method for automatically defrosting a refrigeration system only during non-peak energy demand. The device includes a defrost module that plugs into the current electromechanical defrost timer supplied with frost-free refrigerators. The delay module includes a microprocessor and uses a clock or timekeeping device to delay the power consuming operation of defrosting a refrigerator or freezer. The intent of the invention and device is to reduce appliance power consumption during peak power requirement times. The method of the invention includes the step of delaying the defrost cycle, which uses a defrost heater element and requires energy to heat the appliance, followed by the consumption of additional energy to operate the compressor to cool off the product once the defrost cycle is completed, to a time when power consumption is not at its peak use.

The delay module of the invention includes a microprocessor that monitors the operation of a defrost timer for several cycles of operation such that the delay module can learn the specific operating parameters for the defrost timer.

Once the operating parameters are learned, the defrost timer monitors the compressor run time and anticipates the defrost cycle and prevents the defrost cycle if the defrost cycle will occur during peak power consumption periods. If the defrost is delayed, the delay module will reapply power to the timer motor of the defrost timer once the peak period has passed.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
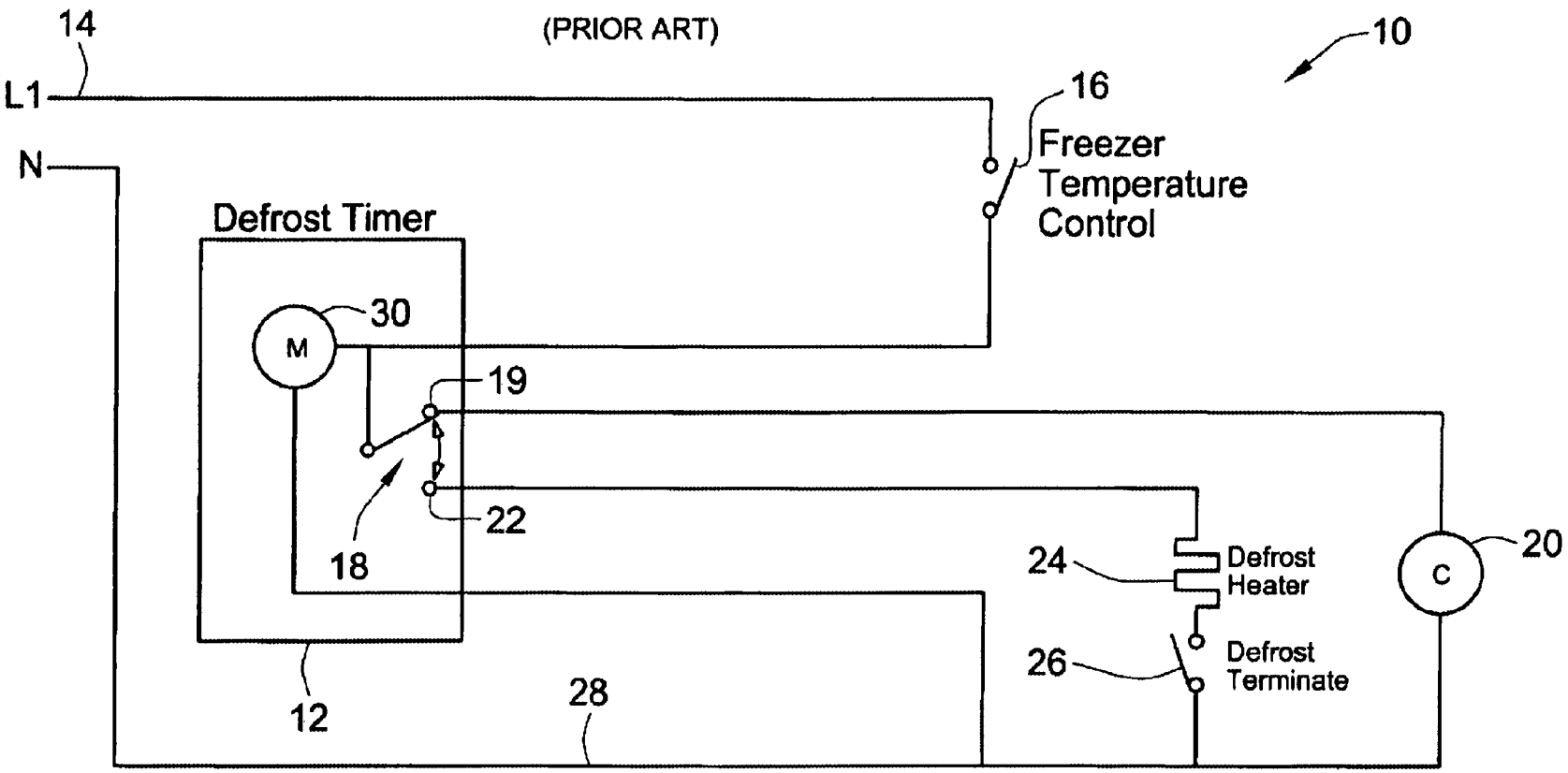
FIG. 1 (PRIOR ART)
FIG. 1 is a schematic illustration of a prior art defrost timer and its interconnection with the refrigeration compressor and defrost heater.

Referring first to FIG. 1, thereshown is a diagram of a prior art control circuit 10 used to control the defrosting of a frost-free refrigerator. As illustrated in FIG. 1, the control circuit 10 includes a defrost timer 12 that is connected to a supply of power 14 through a freezer temperature control switch 16. The freezer temperature control switch 16 is a conventional thermostat that closes to supply power to the defrost timer 12 whenever the temperature within the freezer rises above a selected value.

As shown in FIG. 1, the defrost timer 12 includes a latching device, such as a switch 18, that is movable between a first position and a second position. When the switch 18 is in the first position, as illustrated in FIG. 1, the switch 18 supplies the line voltage 14 through terminal 19 to a compressor 20 used in the frost-free refrigerator. During normal operating conditions, the switch 18 is in the first position such that the compressor 20 runs when the temperature control switch 16 closes. Thus, during normal operating conditions, the freezer temperature control switch 16 directly controls the operation of the compressor 20. Although the latching device is shown as being a switch 18, other types of latching devices, such as an SCR, are contemplated as being within the scope of the present invention.

As illustrated in FIG. 1, when the switch 18 moves to its second position in contact with terminal 22. When the switch 18 is in the second position, the line voltage 14 is supplied to a defrost heater 24. The defrost heater 24 is typically placed around the evaporator coil of the compressor 20 such that the defrost heater 24 is able to defrost the evaporator. As illustrated in FIG. 1, a bimetal defrost terminate switch 26 is positioned between the defrost heater 24 and the neutral line 28. The switch 26 opens the circuit when the bimetal' temperature reaches the set point, thus terminating defrost if the defrost operation is completed before the completion of the defrost cycle determined by the defrost timer.

As illustrated in FIG. 1, the defrost timer 12 includes a timer motor 30 that is connected between the line voltage 14 and the neutral line 28. As can be understood in FIG. 1, the timer motor 30 operates whenever the freezer temperature control switch 16 is closed. Thus, the timer motor 30 is active for the same amount of time as the compressor 20.

Although not shown, the timer motor 30 is coupled to a cam within the defrost timer 12. As the timer motor 30 operates, the cam rotates to control the position of the switch 18. The cam is specifically design such that after a predetermined amount of compressor run time, the cam moves the switch 18 within the timer from the compressor 20 to terminal 22 to provide power to the defrost heater 24, thus initiating the defrost operation.

During the defrost cycle, the temperature control switch 16 remains closed since the compressor 20 is not being run. Thus, power continues to be supplied to the timer motor 30, which continues to move the attached cam. After a predetermined amount of time in the defrost mode, the cam moves the switch 18 back to the compressor mode and the refrigerator is placed back in the cooling mode in which power is supplied to the compressor 20.

As can be understood by the above description, the timer motor 30 controls the position of the switch 18 solely based upon the amount of run time of the compressor 20. Since the amount of run time of the compressor 20 is controlled by the freezer temperature control switch 16, the refrigerator can enter into the defrost mode at any time of the day.

Figure 2:
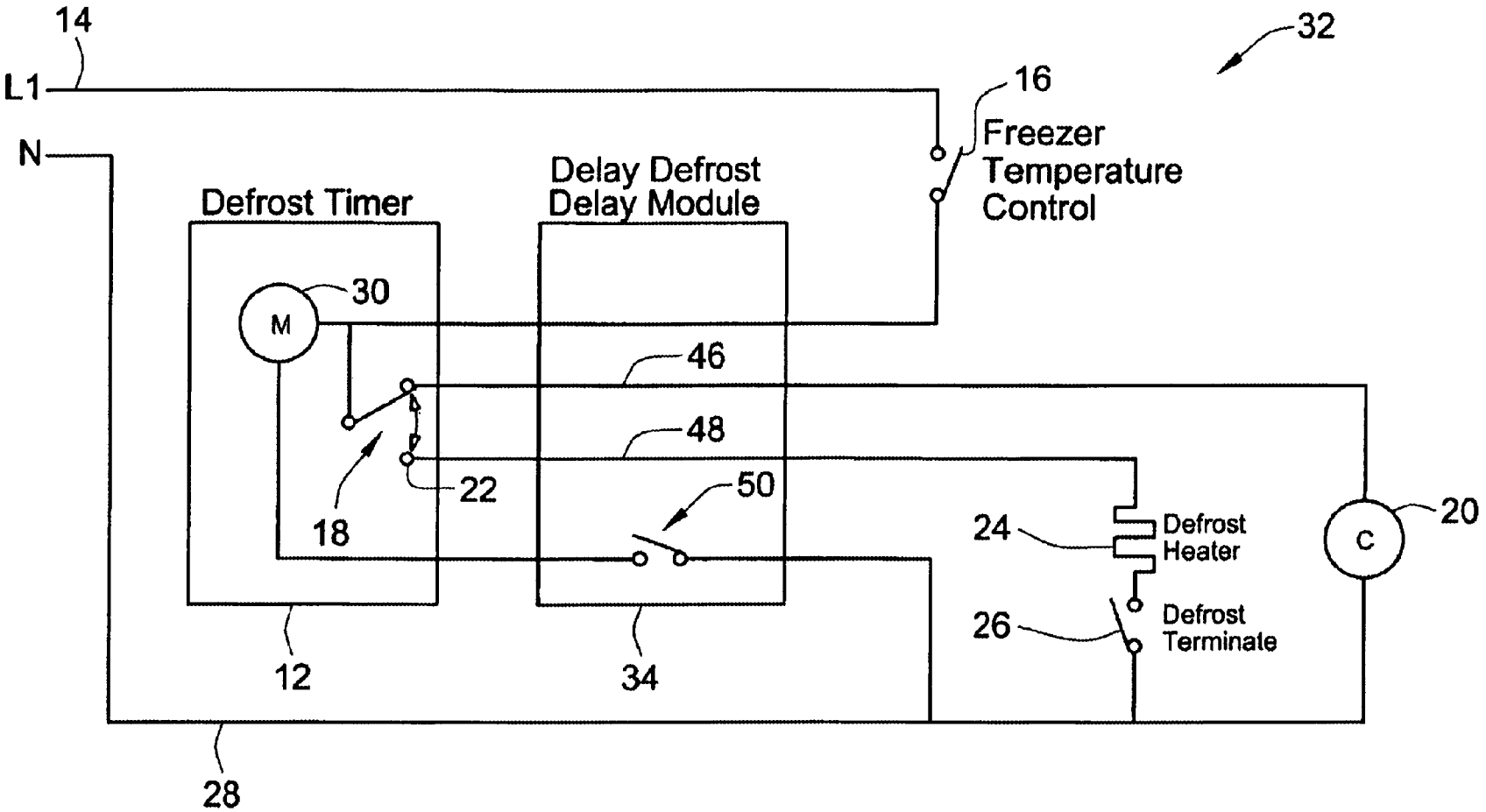
FIG. 2 is a schematic illustration of the defrost delay module of the present invention and its inclusion between the defrost timer and the defrost heater and refrigeration compressor.

Referring now to FIG. 2, thereshown is the control circuit 32 of the present invention. In the schematic of FIG. 2, common reference numerals are used relative to the prior art control circuit 10 shown in FIG. 1 to facilitate understanding. As can be immediately understood in FIG. 2, the control circuit 32 includes a defrost delay module 34 positioned between the defrost timer 12 and the compressor 20 and defrost heater 24. The defrost delay module 34 is a device that allows for the automatic defrosting of the refrigeration system only during times of non-peak energy demand. For example, if peak energy demand is identified as weekdays between 1:00 PM and 8:00 PM, the defrost delay module 34 would prevent the operation of the defrost heater 24 during these time periods.

As can be seen in FIG. 2, the defrost delay module 34 is a module that plugs into the currently available electromechanical defrost timer 12 that is supplied with many frost-free refrigerators. However, it is also contemplated that the features and components of the defrost delay module 34 and the defrost timer 12 could be combined into a single unit while operating within the scope of the present invention.

Figure 3:
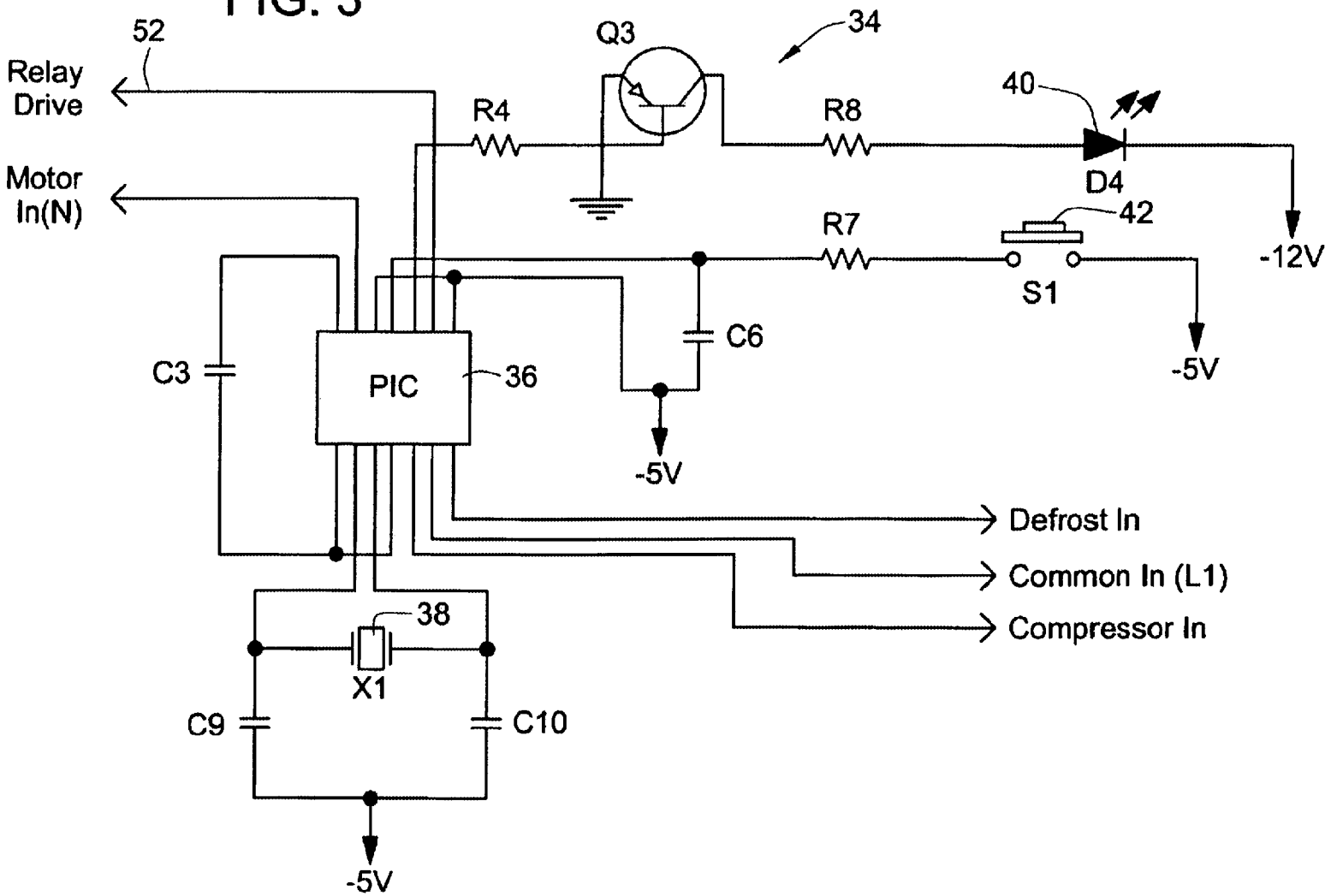
FIG. 3 is a circuit schematic illustrating the configuration of the microprocessor used to operate the defrost delay module.

Referring now to FIG. 3, the defrost delay module 34 includes a microprocessor 36 that controls the operation of the delay module. The microprocessor 36 is connected to an external oscillator 38 connected between a pair of capacitors C9 and C10. The external oscillator 38 allows the microprocessor 36 to keep a reliable and accurate time. As can be seen in FIG. 3, the microprocessor 36 has numerous connections to the various operating components in the entire system. In this manner, the microprocessor 36 can accurately monitor the operation of the defrost timer and the compressor and make the required calculations to be discussed in detail below.

In addition to the input connections, the microprocessor 36 is coupled to an indicator diode 40 through a pair of resistors R4 and R8 and a transistor Q3. A push-button switch 42 is connected to the microprocessor 36 through the resistor R7 and capacitor C6. The push-button switch 42 is used to set the current time within the microprocessor 36. For example, if the current time is 10:00 AM, the switch 42 is depressed ten times. In this manner, the microprocessor 36 can be set to the present time.

Figure 4:
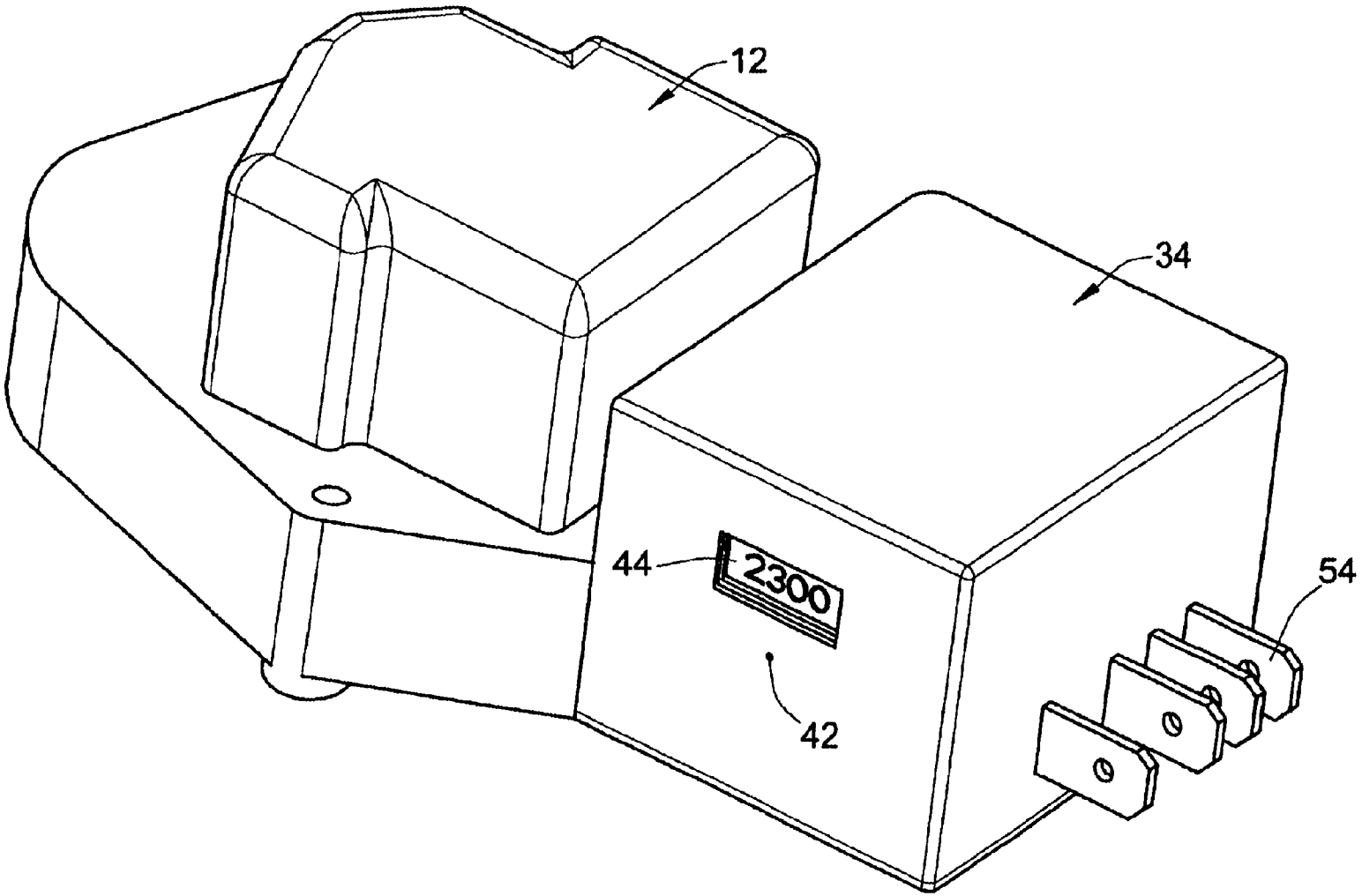
FIG. 4 is a perspective view illustrating the interconnection between the defrost delay module and defrost timer.

As shown in FIG. 4, the push-button switch 42 is accessible through the outer housing of the delay module 34. In the embodiment illustrated in FIG. 4, a time display 44 is viewable through the housing. However, in the preferred embodiment of the invention illustrated in FIG. 3, the diode 40 replaces the time display 44. The diode 40 blinks each time the switch 42 is depressed such that the user can verify the present time being entered into the microprocessor.

Referring back to FIG. 2, the line voltage 14 passes through the delay module 34 and is connected to the timer motor 30. The delay module 34 includes a pair of connectors 46 and 48 that allow the switch 18 to be connected to either the compressor 20 or the defrost heater 24. The delay module 34 further includes a relay 50 that is movable between an open condition, as shown, and a closed condition. While in the closed condition, the relay 50 provides a connection to the neutral line 28. The timer motor 30 can operate only when the relay 50 is in the closed position. Thus, when the relay 50 is in the position shown in FIG. 2, the timer motor 30 is inoperable.

Referring to FIG. 3, the microprocessor 36 is connected to the relay 50 through the relay drive line 52. In this manner, the microprocessor 36 can control the operating position of the relay 50.

When the relay 50 is in the open position, as shown in FIG. 2, the line voltage continues to be applied to the compressor 20. However, when in the open position, the relay 50 prevents operation of the timer motor 30. Thus, by controlling the position of the relay 50, the microprocessor contained within the delay module 34 can control the operation of the timer motor 30.

To install the delay module 34, the external wires from the defrost timer 12 are plugged into the blades 54 extending from the exterior of the delay module 34, as illustrated in FIG. 4. Next, the delay module 34 is plugged into the four terminals of the electromechanical defrost timer 12, thus placing the module in series with the defrost timer 12.

The operation of the defrost delay module 34 will now be described. During the first and second complete cycles of the defrost timer 12, including both the cooling cycle and the defrost cycle, the delay module 34 monitors the amount of time the compressor 20 runs and the length of the defrost time "programmed" into the defrost timer 12. As described previously, the length of the defrost cycle and the amount of compressor run time between defrost cycles is physically controlled by the cam in the defrost timer 12. During the first two complete cycles, the delay module 34 "learns" the operational characteristics of the defrost timer 12 and stores these times in the memory of the microprocessor 36.

During these first two learning cycles, the delay module 34 does not modify the defrost operation of the defrost timer 12. However, during the third cycle and subsequent operating cycles of the defrost timer 12, the delay module 34 will delay the beginning of the defrost cycle as required to prevent the refrigerator from defrosting during times assigned as peak demand times. For example, in some areas, peak demand times are defined as between 1:00 PM and 8:00 PM. In the preferred embodiment of the invention, the peak demand times are pre-set in the microprocessor 36, although it is contemplated that these times could be entered by the user. As discussed previously, the microprocessor contained within the delay module 34 is capable of monitoring time and controlling the operation of the relay 50 based upon the monitor time.

The delay module 34 will prevent the electromechanical defrost timer 12 from switching from the compressor mode to the defrost mode by anticipating the start of the defrost cycle and opening the relay 50 to the timer motor 30. When the relay 50 is opened, the timer motor 30 cannot operate, which stops the cam that forces the switch blades of switch 18 to change from compressor mode to defrost mode. If the microprocessor 36 of the delay module 34 determines that the electromechanical defrost timer 12 would defrost during peak demand time, the delay module 34 will open the relay 50 and stop the timer motor 30 slightly before the defrost timer 12 would switch to the defrost cycle.

The defrost delay module 34 will stop the timer motor 30 by opening the relay 50, thus stopping the timer cam and keeping the timer switch blades in the compressor mode. Once the clock or time keeping device on board the defrost delay module 34 moves out of peak energy time, the defrost delay module 34 closes the relay 50 to reconnect the circuit supplying power to the timer motor 30 in the electromechanical defrost timer 12. Supplying power back to the timer motor 30 would restart the cam that moves the switch 18, thus permitting an off-peak defrost operation. As can be understood in FIG. 2, the compressor 20 is able to operate when the timer motor 30 is shut down.

In a contemplated embodiment of the invention, the microprocessor 36 can be programmed such that if a power outage of significant duration occurs, the microprocessor 36 will take credit for a defrost, thus extending the amount of time before an additional defrost is required, thereby saving power. The defrost delay module 34 could also be configured to provide a random restart delay after restoration of power so that the demand spike after a blackout is softened.

As can be understood by the above description, the present invention is directed to a delay module 34 that prevents the operation of the defrost heater 24 during preselected peak time intervals. The delay module 34 includes an onboard clock and programming that defines a peak period and prevents operation of the defrost heater 24 during such a period. The delay module 34 of the present invention can be placed in series with the conventional defrost timer 12 and programmed to "learn" the operating characteristics of the defrost timer 12. In this manner, the delay module 34 can be retrofit onto existing defrost timers 12 to provide the delay function described.

Various alternatives and embodiments are contemplated as being within the scope of the following claims particularly pointing out and distinctly claiming the subject matter regarded as the invention.

We claim:

1. A method of controlling the operation of a refrigerator having a defrost timer that supplies power to a compressor during a cooling cycle and supplies power to a defrost heater during a defrost cycle, the method comprising the steps of:

positioning a delay module between the defrost timer and both the compressor and the defrost heater;

defining a peak demand period in the delay module; and activating the delay module to prevent the defrost timer from beginning the defrost cycle when the defrost cycle will begin during the peak demand period.

2. The method of claim 1 further comprising the step of keeping the current time within the delay module such that the delay module will prevent the defrost timer from beginning the defrost cycle when the current time is during the peak demand period.

3. The method of claim 1 wherein the defrost timer includes a timer motor that controls the length of the cooling cycle and the defrost cycle, wherein the delay module interrupts the supply of power to the timer motor to prevent the beginning of the defrost cycle.

4. The method of claim 1 further comprising the steps of:

monitoring the length of time the defrost timer operates the compressor during the cooling cycle;

monitoring the length of time the defrost timer operates the defrost heater in the defrost cycle; and anticipating the beginning of the defrost cycle based upon the monitored length of the current cooling cycle and preventing the beginning of the defrost cycle when the anticipated beginning of the defrost cycle is during the peak demand period.

5. The method of claim 4 further comprising the step of resupplying power to the timer motor of the defrost timer when the current time falls outside of the peak demand period such that the defrost timer can trigger the defrost cycle.

6. A method of controlling the operation of a refrigerator having a defrost timer that supplies power to a compressor during a cooling cycle and supplies power to a defrost heater during a defrost cycle, the method comprising the steps of:

positioning a delay module between the defrost timer and both the compressor and the defrost heater, the delay module including a microprocessor configured to keep a current time within the delay module;

defining a peak demand period in the delay module;

determining in the delay module the length of time the defrost timer operates the compressor during the cooling cycle;

determining in the delay module the length of time the defrost timer operates the defrost heater in the defrost cycle;

monitoring the operation of the defrost timer;

anticipating the beginning of the defrost cycle; and preventing the defrost timer from beginning the defrost cycle when the defrost cycle will begin during the peak demand period.

7. The method of claim 6 wherein the defrost timer includes a timer motor that controls the length of the cooling cycle and the length of the defrost cycle, wherein the delay module interrupts the supply of power to the timer motor to prevent the beginning of the defrost cycle.

8. The method of claim 7 further comprising the step of resupplying power to the timer motor of the defrost timer when the current time of outside of the peak demand period such that the defrost timer can trigger the defrost cycle.

9. The method of claim 6 wherein the step of determining the length of time of the cooling cycle and the length of time of the defrost cycle comprises the steps of:

monitoring the length of time of both the cooling cycle and the defrost cycle for an initialization period;

storing the length of time the defrost timer operates the compressor during the cooling cycle in the microprocessor; and storing the length of time the defrost timer operates the defrost heater in the defrost cycle in the microprocessor.

10. The method of claim 9 wherein the initialization period is two cooling cycles and two defrost cycles.

11. The method of claim 10 wherein the defrost delay module includes a latching device operable between an open state and a closed state and the step of interrupting power to the timer motor includes moving the latching device to the open state.

* * * * *